US010316782B2

(12) United States Patent
Sakai et al.

(10) Patent No.: US 10,316,782 B2
(45) Date of Patent: Jun. 11, 2019

(54) PRESSURE REDUCING VALVE CONTROL APPARATUS

(71) Applicant: DENSO CORPORATION, Kariya, Aichi-pref. (JP)

(72) Inventors: Takuya Sakai, Kariya (JP); Hiroyuki Nishimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 135 days.

(21) Appl. No.: 15/708,433

(22) Filed: Sep. 19, 2017

(65) Prior Publication Data

US 2018/0087463 A1 Mar. 29, 2018

(30) Foreign Application Priority Data

Sep. 27, 2016 (JP) ..... 2016-188445

(51) Int. Cl.

| | |
|---|---|
| ***F02D 41/24*** | (2006.01) |
| ***F02D 41/20*** | (2006.01) |
| ***F02M 55/02*** | (2006.01) |
| ***F02M 63/00*** | (2006.01) |

(52) U.S. Cl.

CPC ..... *F02D 41/2464* (2013.01); *F02M 55/025* (2013.01); *F02M 63/0007* (2013.01); *F02D 2041/2051* (2013.01); *F02D 2041/2058* (2013.01)

(58) Field of Classification Search

CPC ..... F02D 41/2464; F02D 41/2429; F02D 41/2438; F02D 41/3809; F02D 41/3836; F02D 2041/2051; F02D 2041/2058; F02D 2200/0602; F02M 55/025; F02M 63/025

See application file for complete search history.

(56) References Cited

U.S. PATENT DOCUMENTS

| | | | | |
|---|---|---|---|---|
| 5,341,839 | A * | 8/1994 | Kobayashi | E03D 3/04 137/505.13 |
| 8,789,511 | B2 * | 7/2014 | Sakata | F02D 41/3863 123/456 |
| 2008/0025849 | A1 | 1/2008 | Okamoto et al. | |
| 2008/0059039 | A1 * | 3/2008 | Nakagawa | F02D 41/2464 701/99 |
| 2008/0087254 | A1 * | 4/2008 | Tanaka | F02D 41/20 123/472 |

* cited by examiner

FOREIGN PATENT DOCUMENTS

| | | |
|---|---|---|
| DE | 102004016554 | 10/2005 |
| JP | 2006-242091 | 9/2006 |

*Primary Examiner* — Erick R Solis
*Assistant Examiner* — Anthony L Bacon
(74) *Attorney, Agent, or Firm* — Nixon & Vanderhye PC

(57) ABSTRACT

A pressure reducing valve control apparatus is provided for a fuel supply system having a common rail and a pressure reducing valve to control rail pressure in the common rail by controlling a current supply state of the pressure reducing valve. The pressure reducing valve operates to open a valve body for discharging fuel from the common rail against a biasing force applied in a valve-closing direction by fuel-generated valve-opening force biasing the valve body in a valve-opening direction by the rail pressure and an electromagnetic force generated by current supply to an electromagnetic coil. The ECU starts to open the valve body during a period of holding a hold value by holding current supplied to the electromagnetic coil at a predetermined hold value after starting current supply to the electromagnetic coil. The ECU sets the hold value to increase as the rail pressure decreases.

7 Claims, 12 Drawing Sheets

PRESSURE REDUCING VALVE CONTROL APPARATUS

CROSS REFERENCE TO RELATED APPLICATION

The present application is based on Japanese patent application No. 2016-188445 filed on Sep. 27, 2016, whole contents of which are incorporated herein by reference.

BACKGROUND

The present disclosure relates to a pressure reducing valve control apparatus, which controls fuel pressure in a pressure accumulation chamber by controlling a valve-opening operation of a pressure reducing valve.

BACKGROUND

A common rail is conventionally used to distribute fuel to each of multiple fuel injection valves, which inject fuel into combustion chambers of an internal combustion engine. The common rail is provided with a pressure reducing valve, which decreases fuel pressure in the rail (referred to as rail pressure below) by discharging the fuel in the rail. JP 2006-242091A discloses one example of a pressure reducing valve, which includes an attachment part attached to a common rail, a valve body for opening and closing a discharge passage formed in the attachment part, a spring member for applying spring force to the valve body in a valve-closing direction and an electromagnetic coil for applying electromagnetic force to the valve body in a valve-opening direction. The valve body is arranged to be in a state to receive the rail pressure in the valve-opening direction.

The pressure reducing valve configured as described above is a normally-closed type. In this type of valve, when current supply to the electromagnetic coil is turned off, the valve body closes a fuel passage by the spring force against the biasing force of the rail pressure (referred to as fuel-generated valve-opening force), which biases the valve body in the valve-opening direction. When the current supply is turned on, the valve body opens the fuel passage against the spring force.

For this reason, the spring force need be larger than the fuel-generated valve-opening force to close the valve when the current supply is turned off. The electromagnetic force need be larger than force, which is determined by subtracting the fuel-generated valve-opening force from the spring force.

In a recent internal combustion engine, the rail pressure is increased to decrease exhaust emissions and improve fuel economy. In case that the rail pressure is increased, the fuel-generated valve-opening force is increased and the spring member is required to have large spring force.

It is however a general practice to variably control the rail pressure in accordance with operation states of the internal combustion engine, for example, to decrease the rail pressure when the internal combustion engine is in an idle operation state. That is, the rail pressure is not always controlled to a maximum pressure. For this reason, in case that the rail pressure is controlled to be low, the fuel-generated valve-opening force is decreased and correspondingly the electromagnetic force required to open the pressure reducing valve against the spring force need be increased. As a result, in case that the spring member having large biasing force is used, the fuel-generated valve-opening force is insufficient and the pressure reducing valve does not open even when the current is supplied under a low rail pressure state.

It is not possible to solve this problem by simply extending a period of current supply to the electromagnetic valve. Although it is possible to increase the electromagnetic force to be sufficiently large by increasing the number of turns of a winding of an electromagnetic coil, the pressure reducing valve becomes upsized. It is also possible to increase the electromagnetic force to be sufficiently large by using a high magnetic material for the electromagnetic coil. However, material cost becomes high.

Although the pressure reducing valve disclosed in JP 2006-242091A is attached to the common rail, the same problem arises in any valve devices other than the common rail as far as the pressure reducing valve is the normally-closed type and attached to the accumulator, in which fluid is accumulated.

SUMMARY

It is therefore an object to provide a pressure reducing valve control apparatus, which surely opens a pressure reducing valve without necessitating upsizing and cost increase.

In one aspect, a pressure reducing valve control apparatus is provided for a pressure reducing valve attached to an accumulator for accumulating pressurized fuel in an accumulation chamber. The pressure reducing valve has an attachment part formed with a discharge passage for discharging the fuel from the accumulation chamber, a valve body arranged to receive fuel pressure in the accumulation chamber in a valve-opening direction and opening and closing the discharge passage, a spring member for applying spring force to the valve body in a valve-closing direction, an electromagnetic coil for applying electromagnetic force to the valve body in the valve-opening direction. The pressure reducing valve control apparatus is characterized by comprising a hold control part and a hold value setting part. The hold control part holds current supplied to the electromagnetic coil at a predetermined hold value after starting current supply to the electromagnetic coil and causes the valve body to start opening within a hold period of the hold value. The hold value setting part sets the hold value to increase as the fuel pressure in the accumulation chamber decreases.

EMBODIMENT

Figure 1:
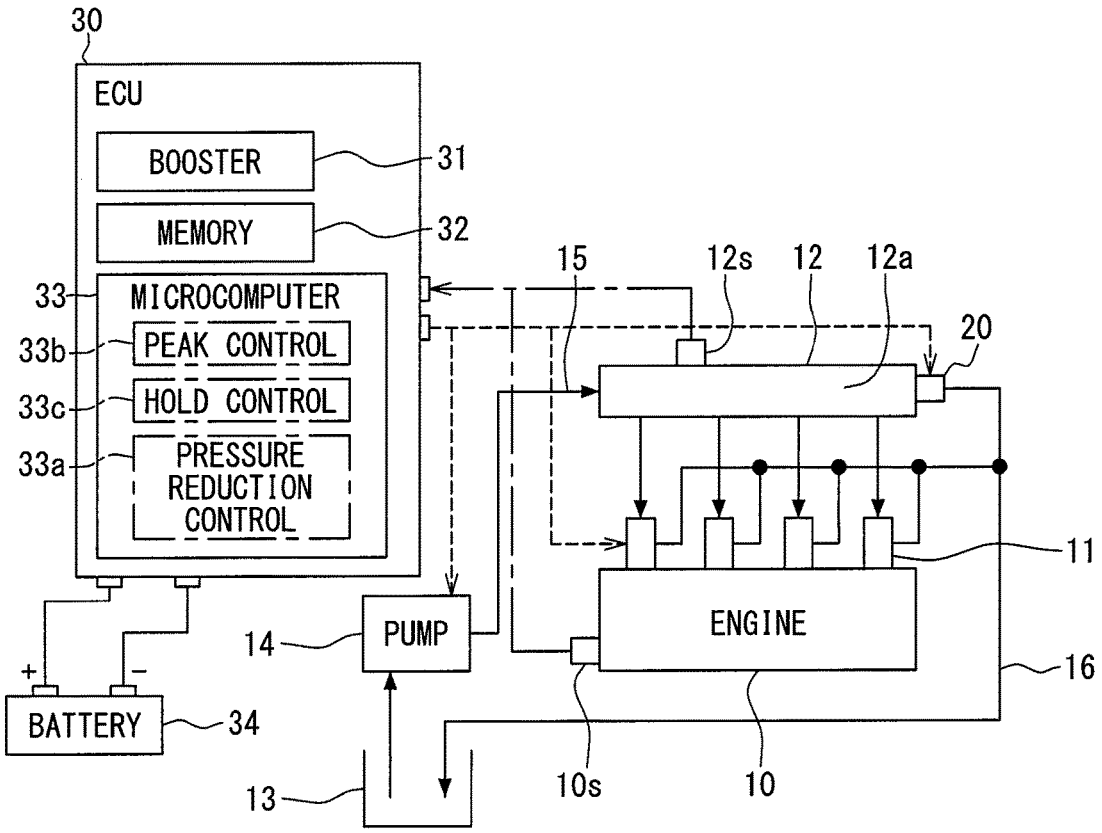
FIG. 1 is a block diagram of a pressure reducing valve control apparatus according to a first embodiment.

A pressure reducing valve control apparatus will be described below with reference to multiple embodiments shown in the drawings. In the following description, same or similar configurations and functions are designated with the same or similar reference numerals among the multiple embodiments for simplification of description. Various physical parameters such as pressure P, force F and the like not only indicate specific parameters but also respective quantities.

First Embodiment

Referring to FIG. 1, an engine 10 is an internal combustion engine mounted in a vehicle so that the vehicle travels by using output power of the engine 10. The engine 10 is a compression self-ignition type diesel engine, which uses light oil as fuel for combustion. The engine 10 has multiple cylinders and is provided with a fuel injection valve 11 on each cylinder. The fuel injection valve 11 injects pressurized fuel into a combustion chamber of each cylinder. Fluid fuel stored in a fuel tank 13 is pressurized by a fuel pump 14 and fed under pressure to a common rail 12 through a high-pressure distribution pipe 15. The common rail 12 accumulates and holds under pressure the high-pressure fuel fed from the fuel pump 14 in an accumulation chamber 12*a* and distributes the high-pressure fuel to multiple fuel injection valves 11.

A pressure reducing valve 20 is attached to the common rail 12. When the pressure reducing valve 20 is driven to open, the high-pressure fuel in the accumulation chamber 12*a* is returned to the fuel tank 13 through a low-pressure pipe 16. A portion of the high-pressure fuel supplied to the fuel injection valves 11 is also returned to the fuel tank 13 through the low-pressure pipe 16.

Figure 2:
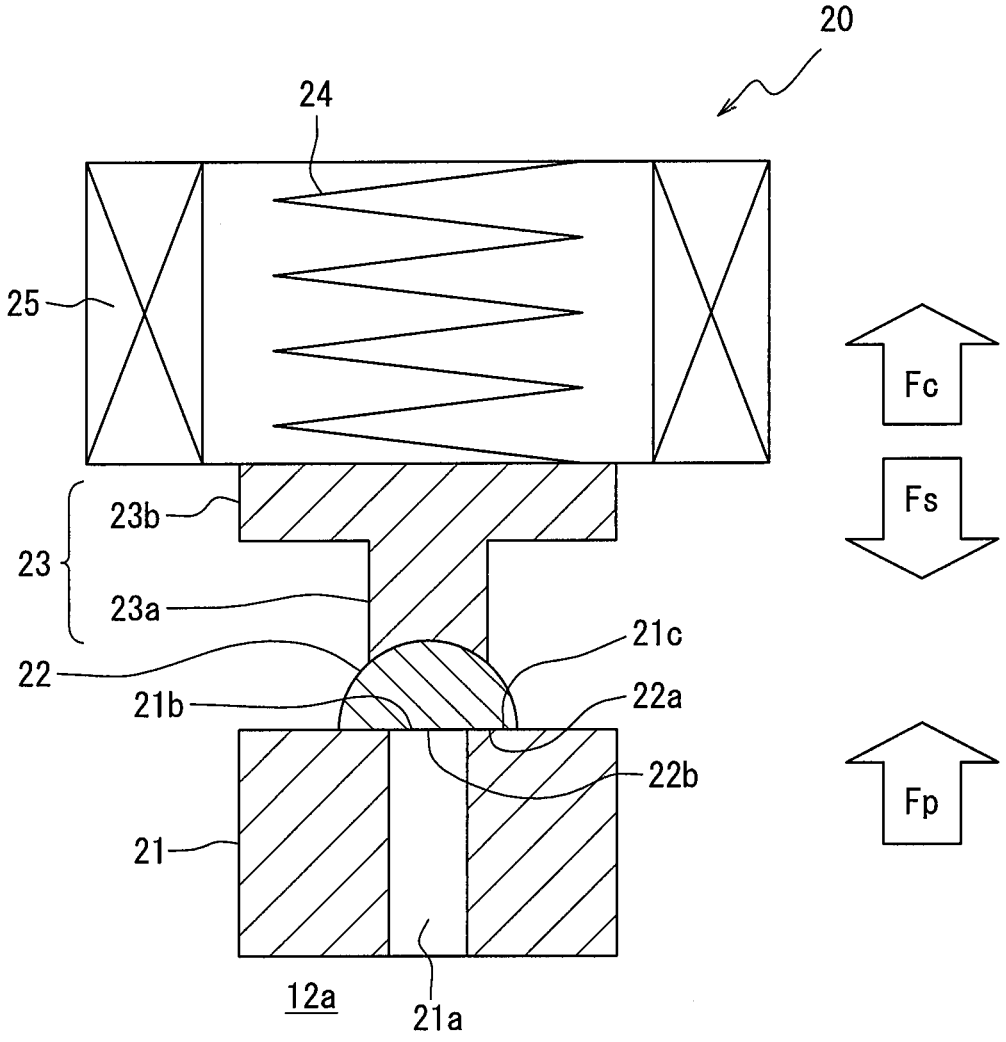
FIG. 2 is a sectional view schematically showing a pressure reducing valve shown in FIG. 1.

As shown in FIG. 2, the pressure reducing valve 20 is an electromagnetically driven type and has an electromagnetic coil 25. The pressure reducing valve 20 is a normally-closed type and closes a fuel passage when current supply to the electromagnetic coil 25 is turned off. The pressure reducing valve 20 includes an attachment part 21 attached to the common rail 12, a valve body 22, a piston 23 and a spring member 24 in addition to the electromagnetic coil 25. The attachment part 21 has a discharge passage 21*a*, which is communicated with the accumulation chamber 12*a* as the fuel passage. A discharge port 21*b* of the discharge passage 21*a* is opened and closed by the valve body 22.

Specifically, a peripheral part, which is a part of an end surface of the attachment part 21 and surrounds the discharge port 21*b*, functions as a seat surface 21*c*, on which the valve body 22 seats. A part of the end surface of the valve body 22, which seats on and off the seat surface 21*c*, is referred to as a seal surface 22*a*. In a closed-valve state of the valve body 22, the seal surface 22*a* tightly contacts the seat surface 21*c* thereby to close the discharge port 21*b*. In this closed-valve state, fuel pressure in the discharge passage 21*a* is the same pressure as rail pressure Pc. In an open-valve state, the seal surface 22*a* leaves from the seat surface 21*c* thereby to open the discharge port 21*b* so that the high-pressure fuel in the accumulation chamber 12*a* is allowed to flow out to the low-pressure pipe 16 through the discharge passage 21*a*.

The piston 23*a* includes a contact part 23*a*, which contacts the valve body 22, and a magnetic circuit part 23*b*, which is a magnetic core forming a part of a magnetic circuit for magnetic flux generated when the electromagnetic coil 25 is supplied with current. The spring member 24 contacts an end surface of the magnetic circuit part 23*b*. Spring force Fs of the spring member 24 is applied continuously to the magnetic circuit part 23*b* in a valve-closing direction. Electromagnetic force Fc generated by current supply to the electromagnetic coil 25 operates to attract the magnetic circuit part 23*b* in a valve-opening direction.

When the seal surface 22*a* leaves even slightly from the seat surface 21*c* and the valve body 22 starts to open, the high-pressure fuel in the discharge passage 21*a* is applied also to the seat surface 21*c*. For this reason, the electromagnetic force Fc required to drive the valve body 22, which started to open the discharge port 21*b*, to a full lift position, is allowed to be smaller than the force Fc required to start valve-opening.

The fuel pressure (that is, rail pressure Pc) in the discharge passage 21*a* under the closed-valve state is applied to the pressure receiving surface 22*b*, which excludes the seal surface 22*a* of the end surface of the valve body 22 and faces the discharge port 21*b*. As a result, fuel-generated valve-opening force Fp, which indicates force generated by application of fuel and equals a product of a surface area A of the surface 22*b* and the rail pressure Pc, is applied to the valve body 22 in the valve-opening direction.

That is, the fuel-generated valve-opening force Fp in the valve-opening direction, the electromagnetic force Fc and the spring force Fs are applied to the piston 23 and the valve body 22 when the current supply to the pressure reducing valve 20 in the closed-valve state is started. Thus, a sum of the electromagnetic force Fc and the fuel-generated valve-opening force Fp corresponds to a valve-opening force. When this valve-opening force Fp+Fc exceeds the spring force Fs, the valve body 22 and the piston 23 starts valve-opening, that is, starts to open the discharge port 21*b*.

The fuel injection valve 11, the fuel pump 14 and the pressure reducing valve 20 are electronically controlled by an electronic control unit (ECU) 30 shown in FIG. 1. The ECU 30 includes a booster circuit 31 for boosting a battery voltage, a memory 32 for storing various information and programs and a microcomputer 33. The microcomputer 33 includes a processor, which executes various arithmetic and logic operation processing in accordance with the programs stored in the memory 32.

The ECU 30 receives detection signals of various sensors such as a crank angle sensor 10*s*, a rail pressure sensor 12*s* and the like. The rail pressure sensor 12*s* detects the rail pressure Pc, which is a pressure of the high-pressure fuel in the accumulation chamber 12*a*. The crank angle sensor 10*s* detects a rotation angle of a crankshaft, which is an output shaft of the engine 10. The microcomputer 33 calculates an engine rotation speed, which is a rotation speed of the crankshaft per unit time, based on a detection value of the crank angle sensor 10*s*. That is, the microcomputer 33 calculates a rotation speed of the output shaft of the engine 10.

The ECU 30 controls driving of the fuel injection valve 11 as follows. The ECU 30 sets a target injection quantity, which is an injection quantity of fuel to be injected each time when the fuel injection valve 11 opens, and a target injection start time based on the engine rotation speed, an engine load and the like. The injection quantity increases as a valve-opening period of the fuel injection valve 11 increases and, in case of the same valve-opening period, as the rail pressure increases. The ECU 30 controls a period of current supply to the fuel injection valve 11, that is, the valve-opening period, based on the rail pressure and the target injection quantity.

The ECU 30 controls driving of the fuel pump 14 and the pressure reducing valve 20 as follows. The ECU 30 sets a target rail pressure, which is a target value of the rail pressure, based on the engine rotation speed, the engine load and the like. For example, the target rail pressure is set to increase as the engine rotation speed increases and the engine load increases. The ECU 30 further feedback-controls the rail pressure based on a deviation of the rail pressure Pc actually detected by the rail pressure sensor 12*s* from the target rail pressure. When the rail pressure Pc is lower than the target rail pressure by more than a predetermined pressure value, the ECU 30 increases a quantity of fuel supplied from the fuel pump 14. When the rail pressure Pc is higher than the target rail pressure by more than a predetermined pressure value, the ECU 30 sets a pressure reducing valve request flag to be ON and drives the pressure reducing valve 20 to open to discharge the high-pressure fuel from the accumulation chamber 12*a* for decreasing the rail pressure Pc.

The microcomputer 33 operates as a pressure reducing control part 33*a* (shown in FIG. 1), which drives the pressure reducing valve 20 to open thereby to decrease the rail pressure Pc, when it controls the pressure reducing valve 20 to open in case that the rail pressure Pc is higher than the target pressure by more than the predetermined value. Further, the ECU 30, which controls the rail pressure Pc by controlling an operation of the pressure reducing valve 20, operates as a pressure reducing valve control apparatus. The pressure reducing valve 20, at least one of the rail pressure sensor 12*s* and the common rail 12, and the ECU 30 form a fuel accumulation system.

Figure 3:
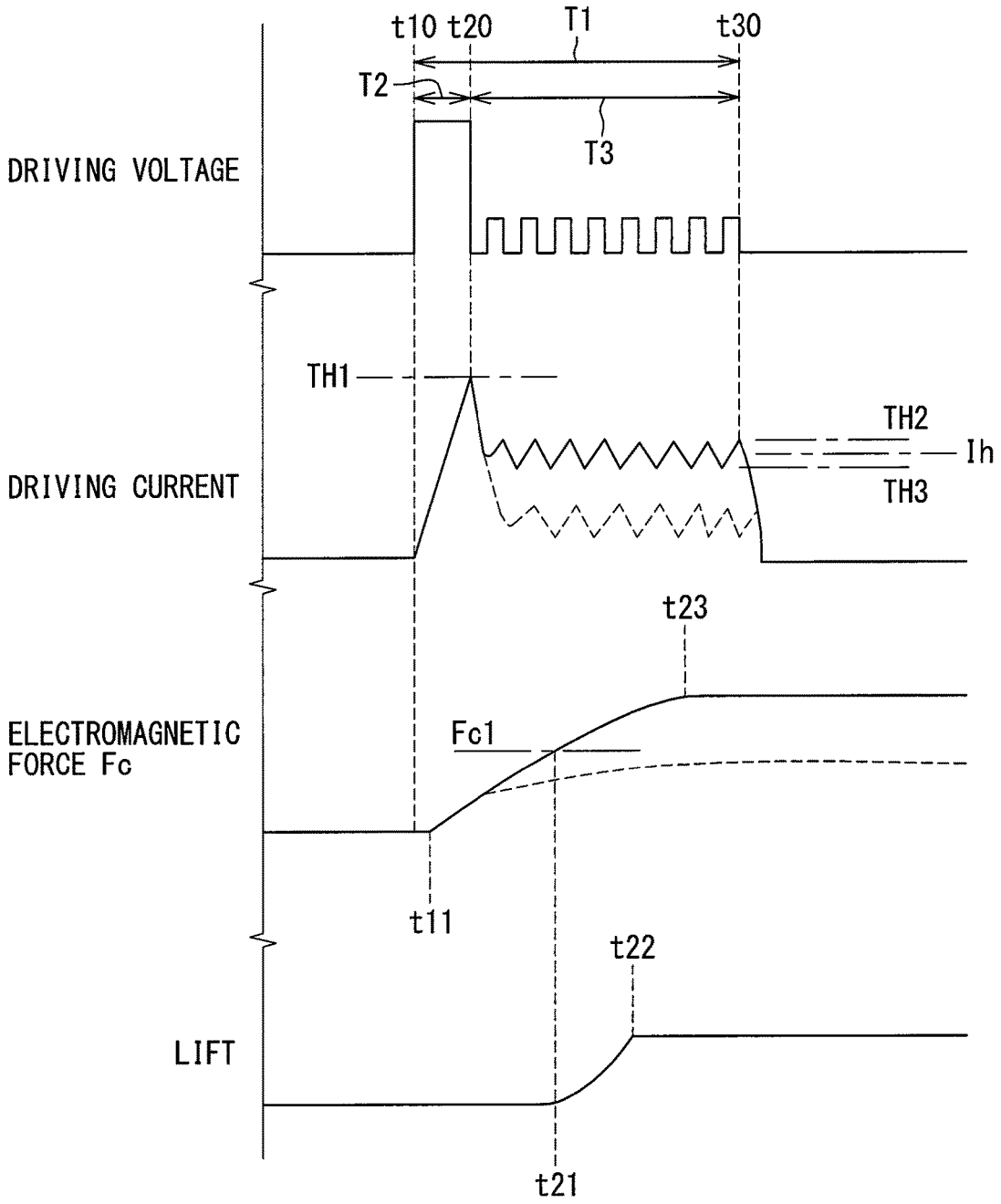
FIG. 3 is a time chart showing control contents of a peak control part and a hold control part shown in FIG. 1.
Figure 4:
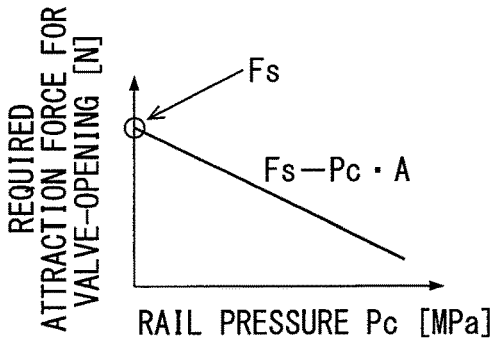
FIG. 4 is a graph showing a relation between attraction force, which is required for driving, and rail pressure.

In case that current is supplied to the pressure reducing valve 20, which is under the valve-closed state, various physical quantities change with time as described in detail below with reference to FIG. 3. In FIG. 3, the first waveform indicates a change with time of a driving voltage, which is a voltage applied to the electromagnetic coil 25 and the second waveform indicates a change with time of a current, which flows to the electromagnetic coil 25. Further, in FIG. 3, the third waveform indicates a change with time of the electromagnetic force Fc and the fourth waveform indicates a change with time of a quantity of lift (movement) of the valve body 22.

In case that the electromagnetic coil 25 is supplied with current based on an ON-state of the pressure reducing valve drive request flag, the current is supplied to the electromagnetic coil 25 only for a predetermined period (current supply period T1) irrespective of values of the rail pressure Pc and the target rail pressure. The current supply period T1 is divided into an initial period T2 and a hold period T3, which follows the initial period T2, as described below.

In the initial period T2, the ECU 30 applies a high voltage boosted by the booster circuit 31 to the electromagnetic coil 25. The driving current starts to rise at current supply start time t10. The ECU 30 periodically detects the driving current and stops applying the boosted voltage when the detected driving current reaches a threshold value TH1 at time t20. Thus the initial period T2 for applying the boosted voltage ends. The threshold value TH1 is fixed to a predetermined current value irrespective of the values of the rail pressure Pc and the target rail pressure.

In the next hold period T3, the ECU 30 applies a voltage of a battery 34 mounted in a vehicle to the electromagnetic coil 25. The ECU 30 controls a duty of an ON-OFF period of application of the battery voltage to hold the driving current at a predetermined hold value Ih. Specifically, the ECU 30 periodically detects the driving current even in the hold period T3. The ECU 30 thus turns off and on the voltage application when the detected driving current rises to a high limit value TH2 and falls to a low limit value TH3, respectively. The high limit value TH2 is set to be higher than the hold value Ih by a predetermined current value. The low limit value TH3 is set to be lower than the hold value Ih by a predetermined current value. The ECU 30 performs duty control to regulate an average value of the driving current to the hold value Ih. The hold value Ih is set variably with the rail pressure Pc as described below.

The microcomputer 33 thus operates as a peak control part 33*b* shown in FIG. 1 in case of controlling a peak value and peak time of a waveform of the driving current by continuously applying the boosted voltage until the driving current rises to reach the threshold value TH1. The microcomputer 33 operates as a hold control part 33*c* shown in FIG. 1 in case of controlling the driving current to the hold value Ih.

As shown in FIG. 3, the electromagnetic force Fc starts to rise at time t11, which is after an elapse of a response delay period from the current supply start time t10. As described above, the sum Fc+Fp of the electromagnetic force Fc and the fuel-generated valve-opening force Fp is the valve-opening force. when this valve-opening force exceeds the spring force Fs, the valve body 22 starts its valve-opening operation. In the example of FIG. 3, when the electromagnetic force Fc increases and reaches a value Fc1 at time t21, the valve-opening force reaches the spring force Fs and the valve body 22 starts valve-opening. The lift quantity thus starts to increase.

The current supply period T1 is set to be sufficiently long so that the valve body 22 reaches the fully-lifted position at time t22 after the valve body 22 started to be lifted at time t21 and stops rising at time t23, which is within the hold period T3, because of saturation of the electromagnetic force Fc. A saturation value of the electromagnetic force Fc is set to be able to generate sufficient valve-opening force even in case that the rail pressure is at the lowest possible value. For this reason, the valve body 22 starts to open within the hold period T3, during which the driving current supplied to the electromagnetic coil 25 is held at the predetermined hold value Ih. Further, the current supply period T1 is set to be sufficiently long so that the valve body 22 stops rising at time t23 with the saturation of the electromagnetic force Fc, which increases after the start of current supply. The saturation value of the electromagnetic force Fc and an increase speed of the electromagnetic force Fc, which increases after the start of current supply, are determined by the number of turns of the electromagnetic coil 25 and the driving current value.

As described above, the valve body 22 starts to open when the sum Fc+Fp of the electromagnetic force Fc and the fuel-generated valve opening force Fp exceeds the spring force Fs. For this reason, the electromagnetic force Fc required to start valve-opening may be decreased as the fuel-generated valve-opening force Fp is increased. The electromagnetic force Fc required to start valve-opening need be increased as the fuel-generated valve-opening force Fp is decreased. Since the fuel-generated valve-opening force Fp is the product of the surface area A of the pressure-receiving surface 22*b* and the rail pressure Pc, the attraction force required for the valve-opening need be increased as the rail pressure Pc is decreased. Theoretically, the attraction force required for the valve-opening equals the spring force Fs in case that the rail pressure Pc is zero.

Figure 5:
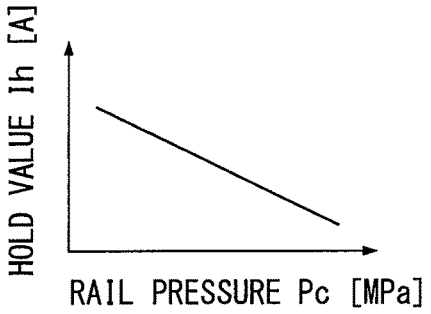
FIG. 5 is a data map showing a relation between a hold value and rail pressure.

In the first embodiment, the hold value Ih is set variably with the fuel-generated valve-opening force Fp. Specifically, the hold value Ih is set to increase as the fuel-generated valve-opening force Fp decreases, that is, as the rail pressure Pc decreases, as indicated by a solid line in FIG. 3. The hold value Ih is set to decrease as the fuel-generated valve-opening force Fp increases as indicated by a dotted line in FIG. 3. A relation between the hold value Ih and the rail pressure Pc is defined as a linear function as indicated in FIG. 5. Thus the hold value Ih is varied linearly with the rail pressure Pc.

Figure 6:
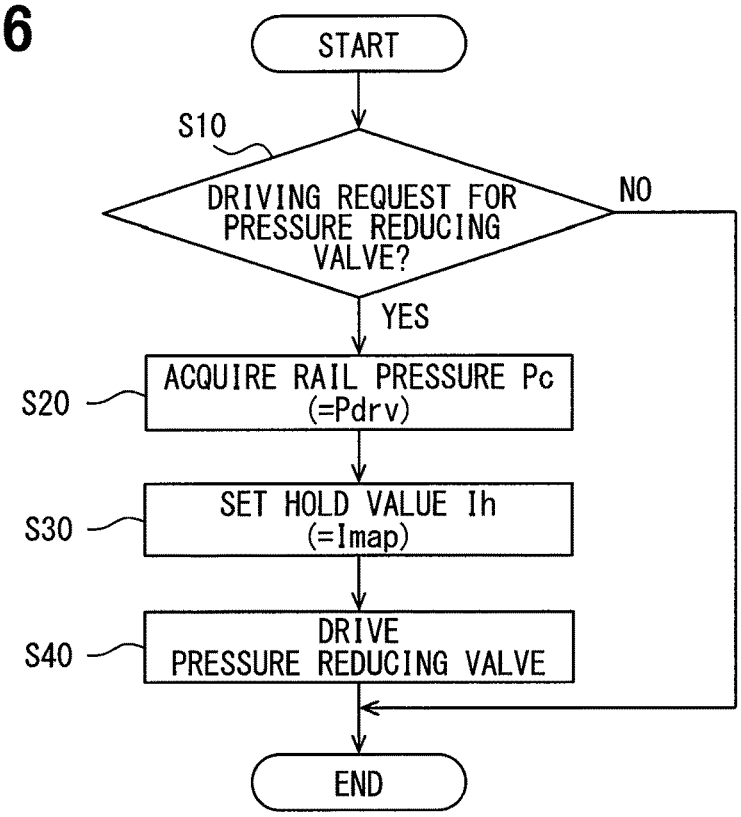
FIG. 6 is a flowchart showing control processing, which is executed by a microcomputer shown in FIG. 1, for driving the pressure reducing valve by setting a hold value.

The processor of the microcomputer 33 repeats execution of the arithmetic and logic processing as shown in FIG. 6 at every predetermined interval during the rotation of the engine 10. The predetermined interval is set to a time interval, which corresponds to a predetermined angular interval of rotation of the crankshaft, in the first embodiment. Alternatively, the predetermined period may be set to a predetermined interval, which corresponds to a time interval such as an operation processing cycle period of the processor.

It is checked first at step S10 whether there is a request for driving the pressure reducing valve 20. The pressure reducing valve driving request flag is set to ON when the rail pressure Pc is higher than the target rail pressure by the predetermined pressure value as described above. That is, it is checked at step S10 whether the pressure reducing valve driving request flag is set to ON.

At the next step S20, the detection value of the rail pressure sensor 12*s* is acquired and the rail pressure Pc is acquired. The value of the rail pressure Pc acquired at step S20 is indicated as Pdry in FIG. 6 and FIG. 7. At the following step S30, the hold value Ih is set based on the rail pressure Pc acquired at step S20. For example, the hold value Ih is set based on the rail pressure Pc with reference to data map shown in FIG. 5 and stored in the memory 32. Alternatively, the hold value Ih may be calculated mathematically by substituting the rail pressure Pc in the linear function shown in FIG. 5 and stored in the memory 32. In the following description, the hold value Ih set based on the data map is indicated as Imap.

The rail pressure Pc used to set the hold value Ih at step S30 may be a present value acquired at step S20 or an average value calculated by using the present pressure value and previous pressure values, for example, an average value of a predetermined number of acquired pressure values. The microcomputer 33 thus operates as a hold value setting part, which sets the hold value Ih to increase as the fuel pressure Pc in the accumulation chamber 12*a* decreases, in executing the processing of step S30.

At next step S40, the voltage is applied to the coil of the pressure reducing valve 20 to drive the pressure reducing valve 20 during the current supply period T1. Specifically, as described in detail with reference to the driving voltage shown in FIG. 3, the boosted voltage is applied during the initial period T2 and the battery voltage is applied during the hold period T3. In applying the battery voltage during the hold period T3, the driving current is duty-controlled to the hold value Ih set at step S30.

Figure 7:
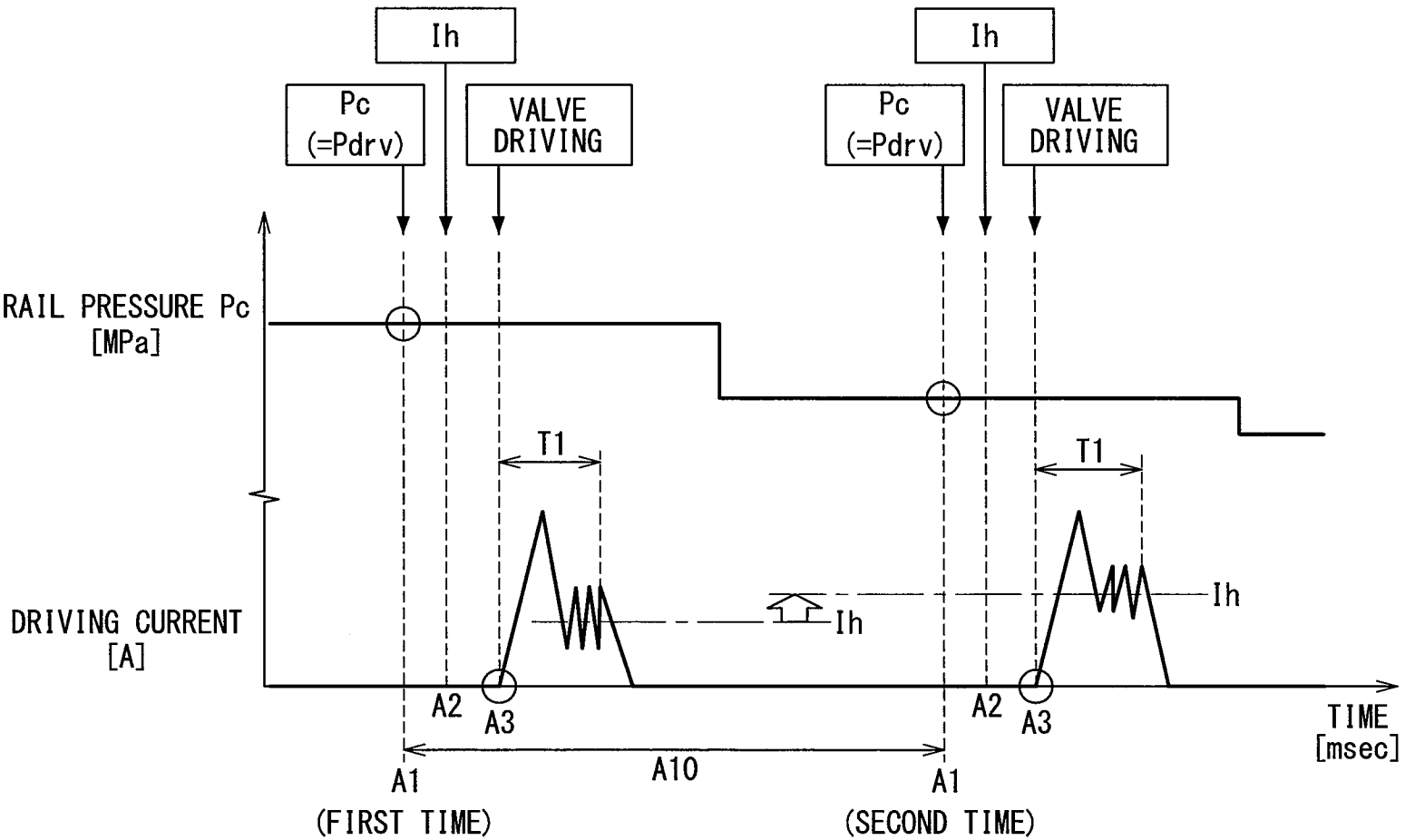
FIG. 7 is a time chart showing one example of changes in the rail pressure and the hold value when the control processing shown in FIG. 6 is executed.

One exemplary change of the rail pressure Pc, which is generated when the control shown in FIG. 6 is repeated, is described below with reference to FIG. 7. In FIG. 7, the abscissa axis indicates time and the ordinate axis indicates the rail pressure Pc and the driving current. At time indicated as A1, the rail pressure Pc is acquired (step S20). Then at time indicated as A2, the hold value Ih is calculated (step S30). At the next time indicated as A3, the voltage application to the electromagnetic coil 25 is started (step S40) to start driving the pressure reducing valve 20 for valve-opening.

The intervals among times indicated as A1, A2 and A3 are set to the predetermined crank angular interval. For example, the hold value Ih is calculated at time when the crank angle increases 30 degrees after acquisition of the rail pressure Pc and then the voltage is applied to the electromagnetic coil 25 when the crank angle further increases 30 degrees.

In the example shown in FIG. 7, the rail pressure Pc is acquired (step S20) each time the crank angle increases by an angle indicated as A10 (for example, 720 degrees). The rail pressure Pc decreases in response to the first driving of the pressure reducing valve 20. This means that the valve body 22 operates to open the discharge port 21*b* normally in response to the first voltage application. Thus, the rail pressure Pc acquired at the second time decreases to be lower than that acquired at the first time. For this reason, in the second calculation of the hold value Ih, the hold value Ih is set to a value larger than that of the first calculation.

Further, in the example shown in FIG. 7, although the rail pressure Pc decreases because of driving of the pressure reducing valve 20 at the first time, the rail pressure Pc remains higher than the target rail pressure by more than the predetermined pressure value and the pressure reducing valve driving request flag is maintained to be ON. For this reason, the pressure reducing valve 20 is driven second time following the driving of the first time in succession.

As described above, the first embodiment provides the following operation and advantage.

Recently, the fuel injection valve 11 is required to inject fuel at higher pressure and the rail pressure Pc is accordingly raised to be higher than before. In case of the pressure reducing valve 20 configured as the normally-closed type valve, which maintains the valve body 22 closed by the spring force Fs when no current is supplied, it becomes necessary that the spring member 24 has sufficiently large spring force Fs to maintain the discharge port 21*b* in the closed state against the high rail pressure Pc. As a result, the sum Fc+Fp of the electromagnetic force Fc and the fuel-generated valve-opening force Fp increases. In case that the fuel-generated valve-opening force Fp is small, the electromagnetic force Fc need be increased to provide sufficient valve-opening force. In case that the electromagnetic force Fc is increased and maintained even when the rail pressure Pc is high, the current supply to the electromagnetic coil 25 becomes wasteful. In addition, since the increased driving current promotes heat generation in the electromagnetic coil 25, an electric resistance of the electromagnetic coil 25 increases and promotes more power consumption.

According to the first embodiment, however, the pressure reducing valve control apparatus (ECU 30) includes the hold control part 33*c* and the hold value setting part (step S30). The hold control part 33*c* holds the current (driving current) supplied to the electromagnetic coil 25 at the predetermined hold value Ih after starting current supply to the electromagnetic coil 25 so that the valve body 22 starts to open the discharge port 21*b* during the hold period. The hold value setting part sets the hold value Ih to increase as the fuel pressure in the accumulation chamber 12*a* decreases.

According to this configuration, the hold value Ih is set to the larger value as the rail pressure Pc is lower in holding the driving current at the hold value Ih and starting the valve body 22 to start opening during the hold period T3. As a result, even in case that the pressure reducing valve 20 is configured to have the spring force Fs set to be large in correspondence to the increased rail pressure Pc, the hold value Ih is set to be large when the rail pressure Pc is low and the fuel-generated valve-opening force Fp is small. Thus, it is possible to provide the sufficient electromagnetic force Fc required for starting valve-opening. The valve-opening operation is ensured without necessitating an increase in the number of turns of the electromagnetic coil 25, which results in large-sizing of the pressure reducing valve 20 and cost increase of the electromagnetic coil 25. In addition, since the hold value Ih is lowered when the rail pressure Pc is high, it is possible to decrease wasteful power consumption when the fuel-generated valve-opening force Fp is high.

Second Embodiment

Figure 8:
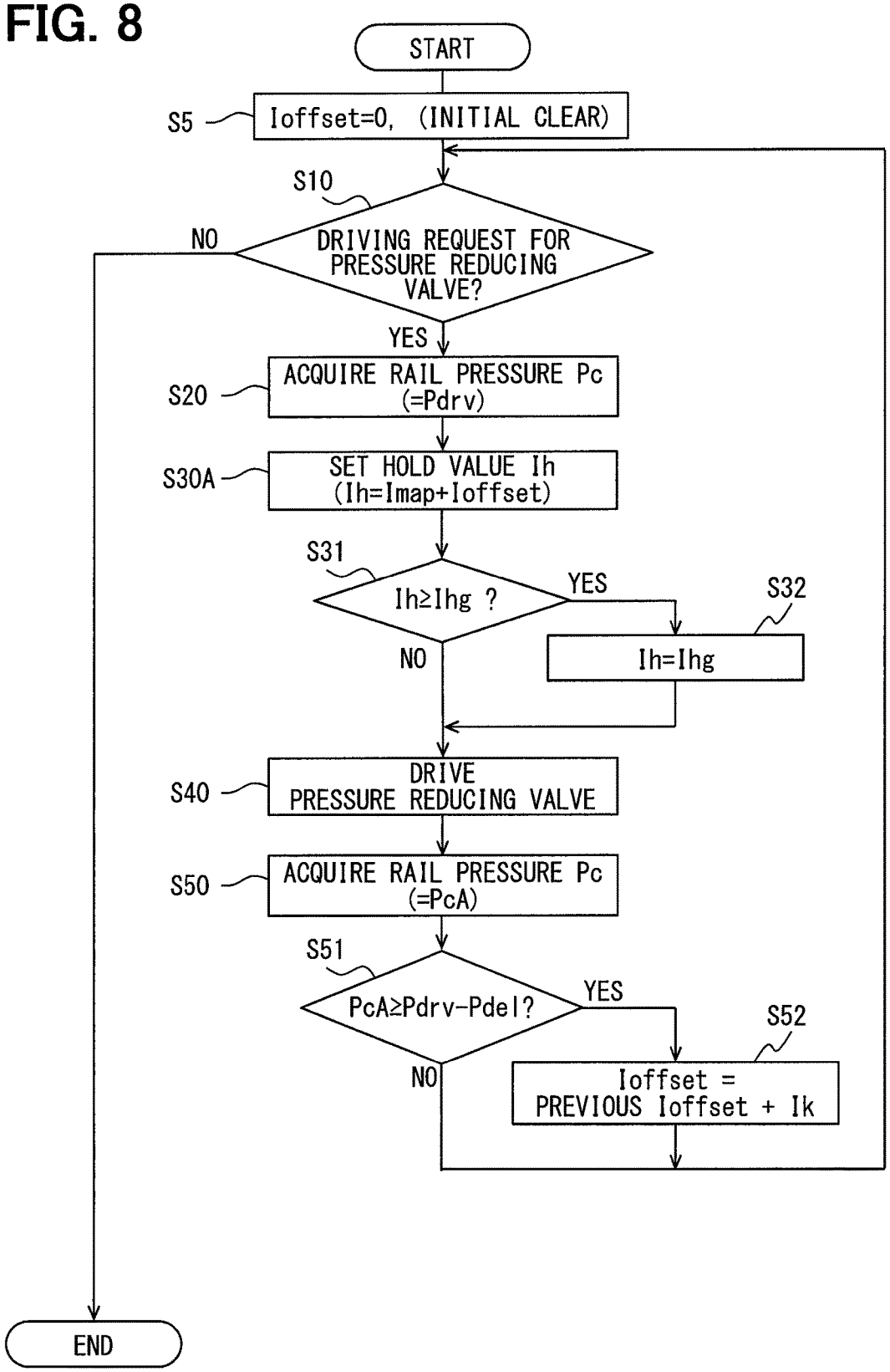
FIG. 8 is a flowchart showing control processing for driving a pressure reducing valve by setting a hold value in control executed by a pressure reducing valve control apparatus according to a second embodiment.

A second embodiment is similar to the first embodiment but different from the first embodiment in that the control contents shown in FIG. 6 are changed as shown in FIG. 8. The hardware configuration such as the pressure reducing valve 20 and the like, which are controlled by the ECU 30 is the same as the configuration shown in FIG. 1. Specifically, steps S5, S31, S32, S51 and S52 are added in the control contents as shown in FIG. 8.

In the processing of FIG. 8, first at step S5, an offset value Ioffset, which is set at step S52 described later, is set to zero. That is, the offset value Ioffset is cleared to initial value.

Step S51 is executed after acquiring the rail pressure Pc at step S50. At step S51, it is checked whether a decrease amount of the rail pressure Pc, which is caused by driving the pressure reducing valve 20 at step S40, is smaller than a predetermined value PdeI. In case that the decrease amount is smaller than the predetermined value PdeI, it is insufficient pressure reduction state, which indicates that the rail pressure Pc is not decreased sufficiently. The microcomputer 33 operates as a decrease amount acquisition part, which acquires the pressure decrease amount of fuel pressure caused by current supply to the electromagnetic coil 25, in executing the processing of step S51.

Specifically, the rail pressure Pc (=PcA) acquired at step S50 is regarded as a post-opening rail pressure PcA, which is present immediately after the pressure reducing valve 20 is driven to open. Further, the rail pressure Pc (=Pdrv) acquired at step S20 is regarded as a pre-opening rail pressure Pdrv, which is present immediately before the pressure reducing valve 20 is driven to open. In case that the post-opening rail pressure PcA is equal to or higher than a pressure, which is lower than the pre-opening rail pressure Pdry by the predetermined value PdeI, the processing of step S52 is executed.

In case that it is the insufficient pressure reduction state, a present value of the offset value Ioffset is calculated by adding a predetermined offset value Ik to a previous value of the offset value Ioffset. In case that it is not the insufficient pressure reduction state, the present value of the offset value Ioffset is maintained at the previous value.

After execution of steps S51 and S52, processing returns to step S10. In case that it is determined at step S10 that there is no driving request, the processing shown in FIG. 8 is finished and the offset value Ioffset is cleared to the initial value at the time of executing the processing of FIG. 8 next time. In case that it is determined at step S10 that there is no driving request, the rail pressure Pdry present immediately before step S20 is acquired at step S20 and the hold value Ih is set at the following step S30A.

At step S30 (hold value setting part) shown in FIG. 6 of the first embodiment, the map value Imap exemplified in FIG. 5 is used as the hold value without any modification. In the second embodiment, however, at step S30A (hold value setting part), the map value Imap exemplified in FIG. 6 is corrected by adding the offset value Ioffset and the hold value is set as Ih=Imap+Ioffset.

Then, unless it is determined to be NO at step S31 described below, the pressure reducing valve 20 is driven at step S40 by using the hold value Ih, which is calculated at step S30A as the sum of the map value Imap and the offset value Ioffset. Thus the hold value Ih is increased each time an offset amount Ik is added at step S52.

At the processing of step S31, which is executed after setting the hold value Ih at step S30A, it is checked whether the hold value Ih is equal to or larger than a predetermined guard value Ihg. In case of determination that the hold value Ih is equal to or larger than the guard value Ihg, the hold value Ih is set to the guard value Ihg at the next step S32.

That is, in case that the rail pressure Pc is determined to be equal to or higher than the predetermined value at step S51, it is highly likely that, although the voltage is applied to the electromagnetic coil 25 in the previous driving control of the pressure reducing valve 20, the valve body 22 is not actually opened and the rail pressure Pc is not decreased. That is, it is in the insufficient pressure reduction state. For this reason, in case that the rail pressure Pc is not decreased in spite of the driving control at step S40, the offset value Ioffset is increased by an amount of the unit offset amount Ik. Thus, in the next pressure reducing valve driving control, the hold value Ih is larger than the previous value and hence the valve body 22 is enabled to open easily with the increase in the electromagnetic force Fc. In case that the hold value Ih is increased excessively by repetition of the processing of step S52, a large driving current continues to flow during the hold period T3 and may damage a driving circuit and the like in the worst situation. To counter this problem, the processing at steps S31 and S32 restrict the hold value Ih from exceeding the guard value Ihg.

That is, the pressure reducing valve driving control of step S40 is repeated until it is determined at step S10 that there is no driving request to the pressure reducing valve 20, that is, until the rail pressure Pc is decreased to be lower than the pressure, which is higher than the target rail pressure by the predetermined value.

The microcomputer 33 operates as a current re-supply part in executing the processing of step S52. In case that the decrease of the rail pressure from the previous value is smaller than the predetermined value PdeI or the rail pressure has not decreased, the current re-supply part sets again the hold value Ih to be larger than the hold value Ih, which is used in the current supply at present, and performs the current supply again. The microcomputer 33 operates as a guard control part, which restricts the hold value Ih from being set to be larger than the predetermined guard value Ihg in setting the hold value Ih again by the current re-supply part, in executing the processing of steps S31 and S32.

One exemplary change of the rail pressure Pc, which is generated when the control shown in FIG. 8 is repeated, is described below with reference to FIG. 9, particularly in respect of the difference from the example of the first embodiment shown in FIG. 7. At first time indicated as A1 in FIG. 9, the rail pressure Pc, that is, the pre-opening rail pressure Pdry is acquired at step S20. Then at time indicated as A2, the hold value Ih is calculated at step S30A. At the next time indicated as A3, the voltage application to the electromagnetic coil 25 is started at step S40 to start driving the pressure reducing valve 20 for valve-opening.

Then, with the rail pressure Pc present at time indicated as A4, that is, the post-opening rail pressure PcA does not decrease, the comparison at step S51 results in YES. For this reason, at time indicated as A5, the offset value Ioffsset is increased by the unit offset amount Ik. Thus, the hold value Ih set at the second time indicated as A2 is larger than the hold value Ih of the first time by the unit offset amount Ik. At second time indicated as A3, the pressure reducing valve 20 is driven by using the increased hold value Ih.

With the post-opening rail pressure PcA acquired at the second time being decreased from the pre-opening rail pressure Pdry acquired at the second time, the offset value Ioffset is not increased at step S52 and the hold value Ih is maintained at the same value as the previous time. The pre-opening rail pressure Pdry acquired at the third time is decreased but still higher than the target rail pressure by the predetermined value. For this reason, since the pressure reducing valve driving request is outputted continuously and the check result at step S10 indicates YES, the pressure reducing valve 20 is driven by using the same hold value Ih as the previous time.

As described above, the second embodiment provides the following operation and advantage.

In case that the rail pressure Pc is not decreased sufficiently in spite of the voltage application to the electromagnetic coil 25, it is highly likely that the insufficient pressure reduction state is present. That is, it is highly likely that the pressure reduction is insufficient because the valve body 22 is not enabled to open due to the insufficiency of electromagnetic force or the valve body 22 is not enabled to continue opening because the valve-opening period is not sufficiently long.

The ECU 30 according to the second embodiment therefore has the decrease amount acquisition part (step S51) and the current re-supply part (step S52). The decrease amount acquisition part acquires the decrease amount of fuel pressure caused by the current supply to the electromagnetic coil 25. The current re-supply part sets the hold value Ih to be larger than that used in the current supply of this time again and supplies the current to the electromagnetic coil 25 again, when the decrease amount is smaller than the predetermined value PdeI or the fuel pressure is the same. Since the current is supplied again after setting the hold value Ih to the increased value when the insufficiency of pressure reduction is present, it is easy to avoid disabled opening or insufficient opening. It is thus possible to surely lower the rail pressure Pc to a desired pressure value.

In case that the insufficient pressure reduction state continues even after repeating the current supply plural times, the hold value Ih is set repeatedly at step S52. This repeated setting of the hold value Ih tends to increase the hold value Ih excessively. In this case, a large driving current tends to flow during the hold period T3 and damage the circuit.

To avoid this problem, the ECU 30 according to the second embodiment has the guard control part (steps S31 and S32). The guard control part prohibits, in setting the hold value Ih again by the current re-supply, the hold value Ih from being set to the large value, which exceeds the predetermined guard value Ihg. Since the hold value Ih is thus limited not to exceed the guard value Ihg, it is possible to limit the driving current from increasing excessively.

Third Embodiment

Figure 10:
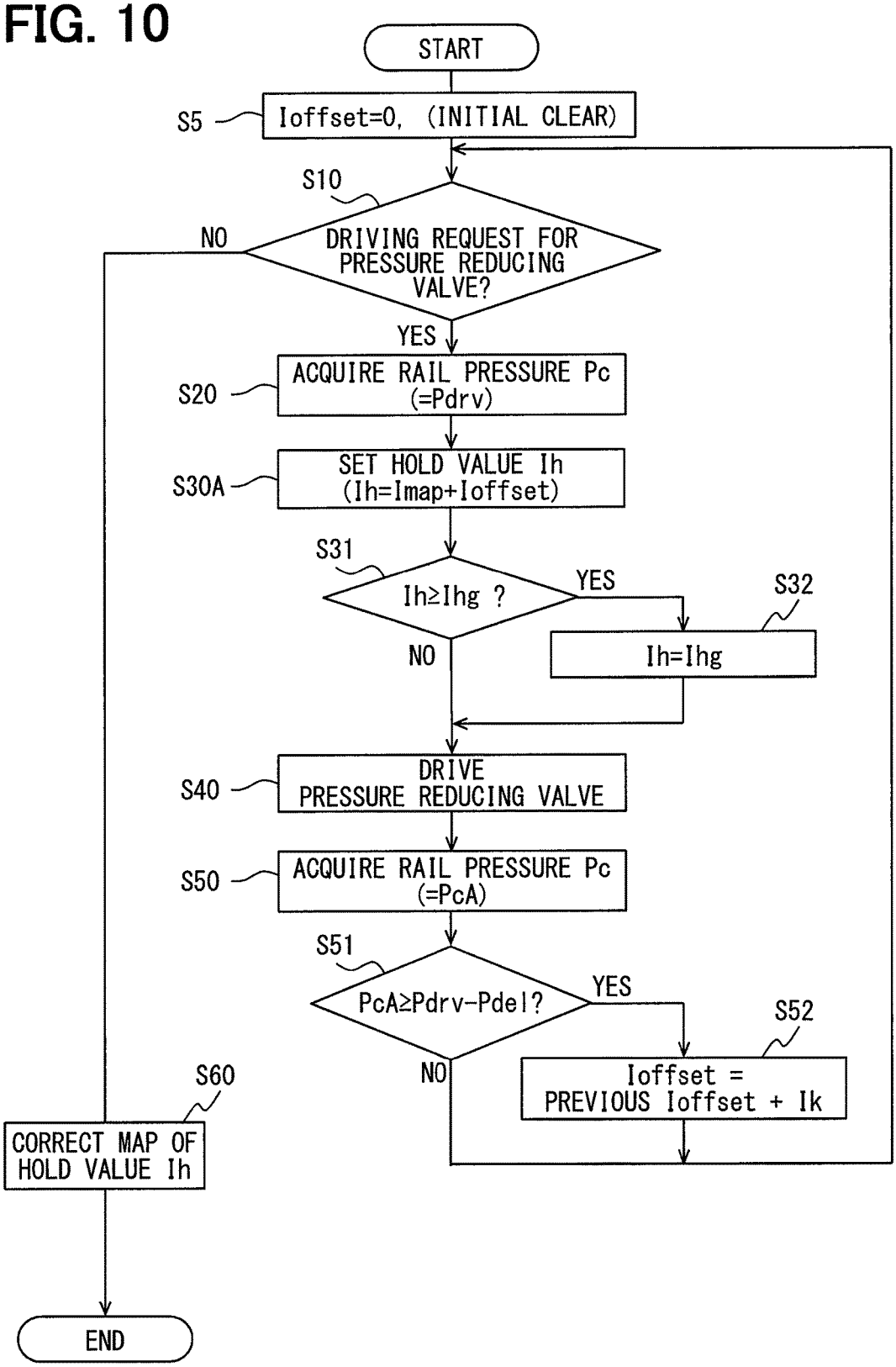
FIG. 10 is a flowchart showing control processing for driving a pressure reducing valve by setting a hold value in control executed by a pressure reducing valve control apparatus according to a third embodiment.

A third embodiment is similar to the second embodiment but different from the second embodiment in that the control contents shown in FIG. 8 are changed as shown in FIG. 10. The hardware configuration such as the pressure reducing valve 20 and the like, which are controlled by the ECU 30, is the same as the configuration shown in FIG. 1. Specifically, step S60 is added in the control contents as shown in FIG. 10.

The processing at step S60 is executed in case that it is determined at step S10 that there is no pressure reducing valve driving request, that is, the rail pressure Pc is sufficiently decreased by driving the pressure reducing valve 20 by step S40. At step S60, the hold value Ih used in the most recent pressure reducing valve driving of step S40 is learned in correlation with the rail pressure Pc acquired at step S20 most recently. Specifically, a value of the map (map value Imap) or function used for calculating the hold value Ih at step S30A is corrected based on the learned hold value and the rail pressure Pc and updated.

The memory 32 storing the data map or function operates as a memory part, which stores as learning information the relation between the map value Imap used for setting by the hold value setting part and the rail pressure. The microcomputer 33 operates as a leaning part, which updates the leaning information and stores the updated information, in executing the processing of step S60. The leaning information represents the relation between the rail pressure Pc, which is present before starting the current supply to the electromagnetic coil 25, and the hold value Ih, which is used in the power supply this time, in case that the rail pressure Pc decreased more than the predetermined value because of driving of the pressure reducing valve 20. The hold value setting part (step S30A) sets the hold value Ih of the next and subsequent times based on the learning information stored in the memory 32.

Figure 11:
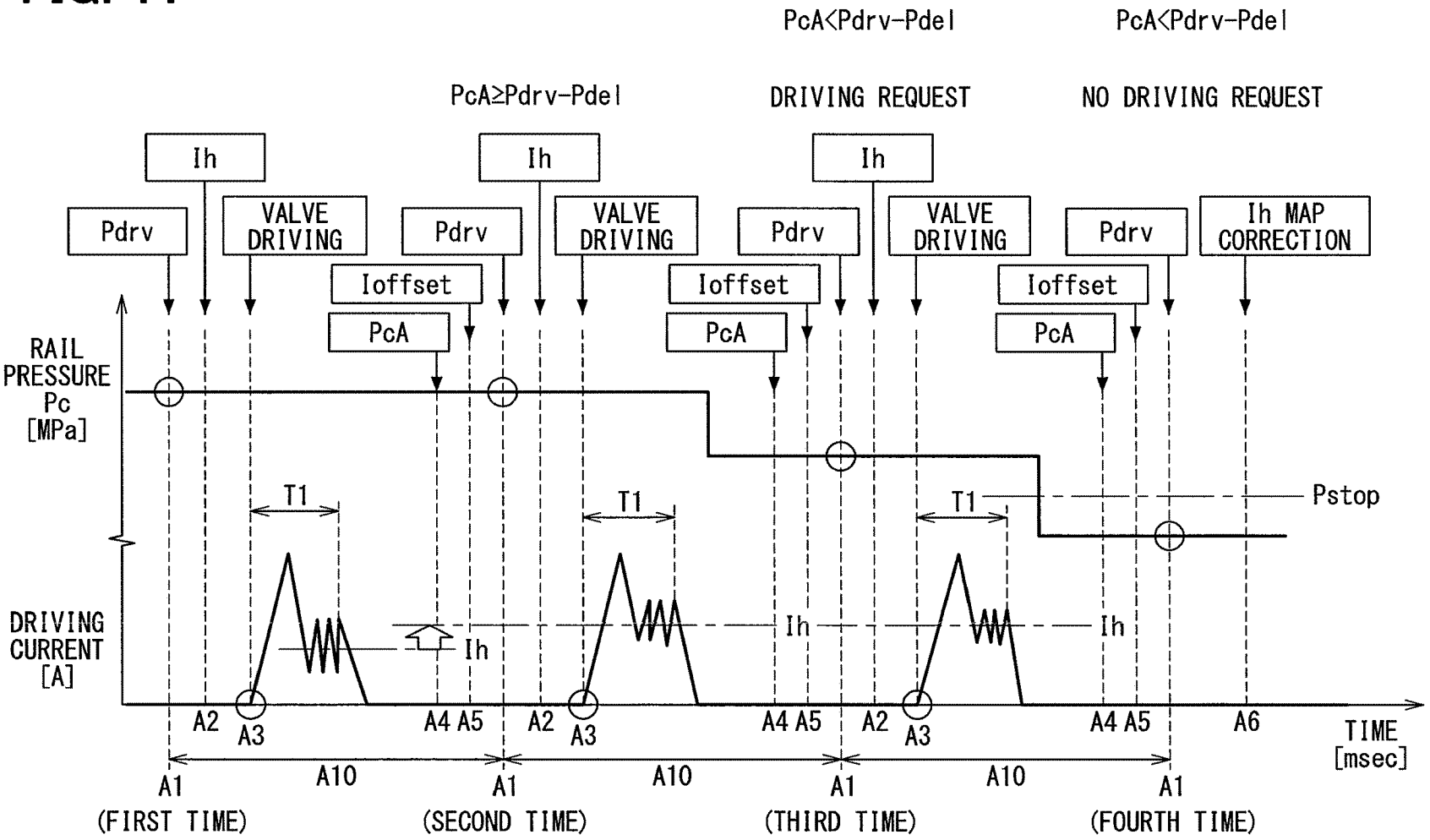
FIG. 11 is a time chart showing one example of changes in the rail pressure and the hold value when the control processing shown in FIG. 10 is executed.

One exemplary change of the rail pressure Pc, which is generated when the control shown in FIG. 10 is repeated, is described below with reference to FIG. 11, particularly in respect of the difference from the example shown in FIG. 9. At first time indicated as A1 in FIG. 11, the rail pressure Pc, that is, the pre-opening rail pressure Pdry is acquired at step S20. Then at time indicated as A2, the hold value Ih is calculated at step S30A. At the next time indicated as A3, the voltage application to the electromagnetic coil 25 is started at step S40 to start driving the pressure reducing valve 20.

Figure 9:
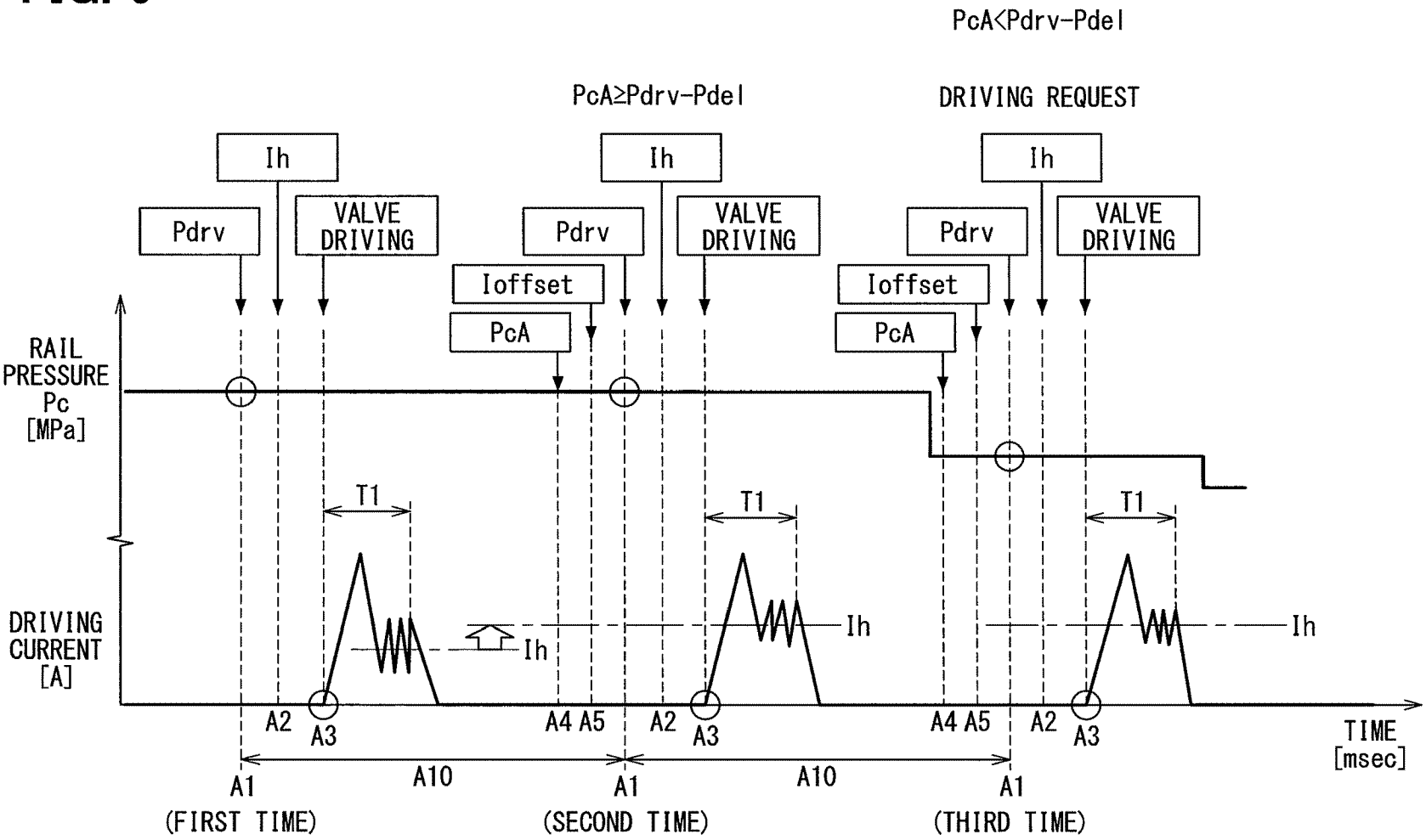
FIG. 9 is a time chart showing one example of changes in the rail pressure and the hold value when the control processing shown in FIG. 8 is executed.

Then, with the rail pressure Pc present at time indicated as A4, that is, the post-opening rail pressure PcA present immediately after the driving not decreasing, the pressure reducing valve 20 is driven by using the offset value Ioffset increased at step S52 similarly to the operation shown in FIG. 9. Then the post-opening rail pressure PcA acquired at the second time is decreased from the pre-opening rail pressure Pdry acquired at the second time and the pressure reducing valve driving request is outputted continuously. Thus, similarly to the operation shown in FIG. 9, the pressure reducing valve 20 is driven by using the same hold values Ih as the previous value. Then the post-opening rail pressure PcA acquired at the third time is decreased from the pre-opening rail pressure Pdry acquired at the third time and the pressure reducing valve driving request is not outputted any more. As a result, at time indicated as A6, map data of the hold value Ih is corrected at step S60.

As described above, the third embodiment provides the following operation and advantage.

The ECU 30 according to the third embodiment has the memory 32 (memory part), which stores as the learning information the relation between the hold value Ih used by the hold value setting part (step S30A) and the rail pressure Pc, and the learning part (step S60). The learning part learns the relation between the rail pressure Pc, which is present before starting the current supply to the electromagnetic coil 25, and the hold value Ih used in the present current supply, and stores the learned relation as the learning information, in case that the decrease amount of the rail pressure Pc is equal to or larger than the predetermined quantity. The hold value setting part (step S30A) sets the next and subsequent hold values Ih based on the learning information stored in the memory 32.

Thus, in case that the pressure reducing valve 20 does not open because of insufficiency of the electromagnetic force Fc and hence the rail pressure Pc does not decrease, the voltage application is performed again by increasing the hold value Ih. In case that the electromagnetic force Fc is increased to be sufficient, the hold value Ih used at that time is stored in the memory 32 as the learning information correlated with the rail pressure Pc. In the pressure reducing valve driving control performed next time, the hold value Ih is set by using the learned map or the function. As a result, it is possible to surely set the hold value Ih relative to the rail pressure P to an appropriate value, that is, a minimum value, which is required for valve-opening.

Fourth Embodiment

Figure 12:
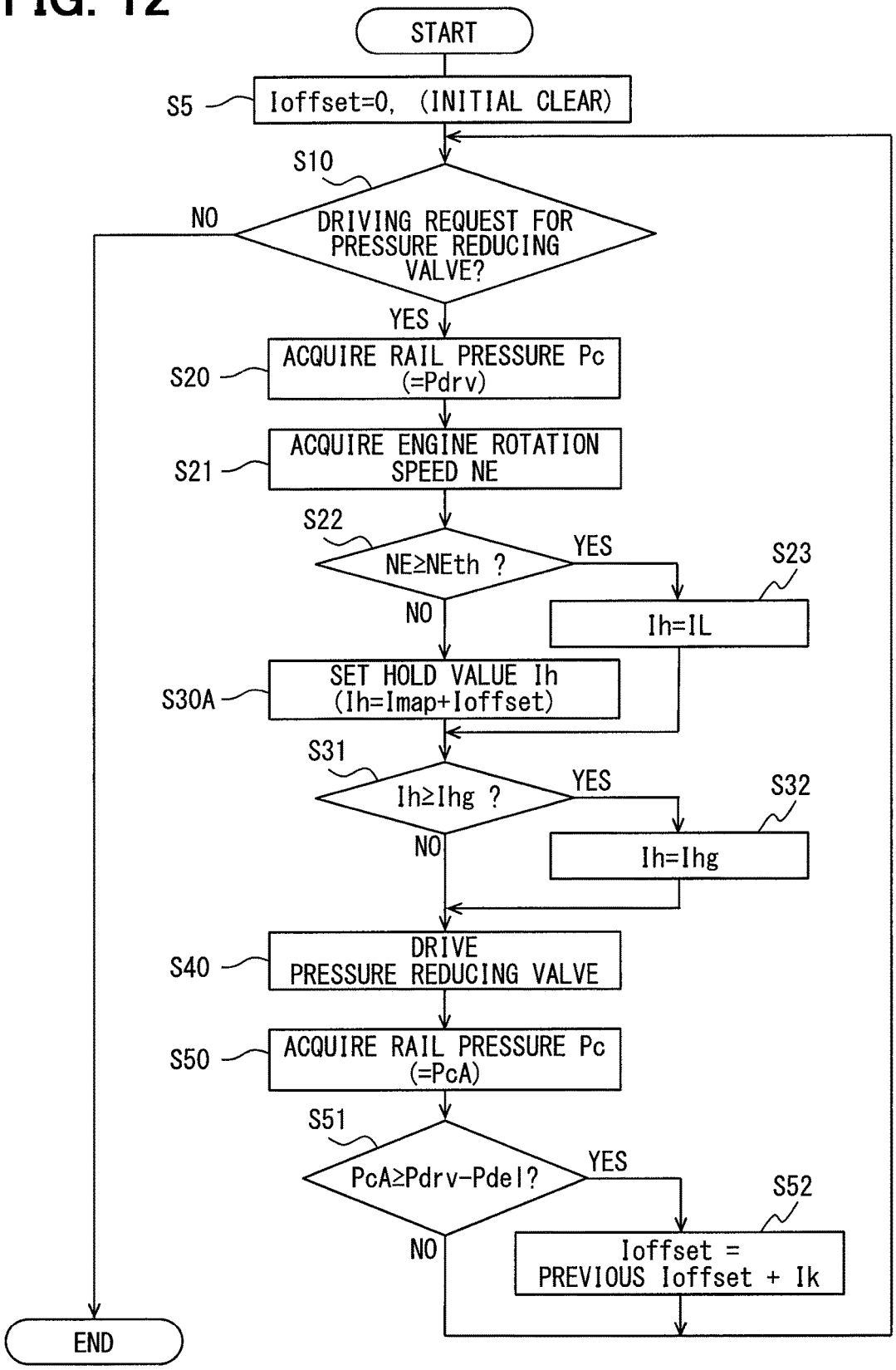
FIG. 12 is a flowchart showing control processing for driving a pressure reducing valve by setting a hold value in control executed by a pressure reducing valve control apparatus according to a fourth embodiment.

A fourth embodiment is similar to the second embodiment but different from the second embodiment in that the control contents shown in FIG. 8 are changed as shown in FIG. 12. The hardware configuration such as the pressure reducing valve 20 and the like, which are controlled by the ECU 30, is the same as the configuration shown in FIG. 1. Specifically, steps S21, S22 and S23 are added in the control contents as shown in FIG. 12.

Processing of step S21 is executed after a determination at step S10 that the pressure reducing valve driving request is present and the pre-opening rail pressure Pdry is acquired. At step S21, an engine rotation speed NE detected by the crank angle sensor 10*s* is acquired. At the next step S22, it is checked whether the engine rotation speed NE acquired at step S21 is equal to or higher than a predetermined threshold value NEth, that is, in a high rotation state. With a determination that the engine rotation speed is in the high rotation state, the hold value Ih is set to a predetermined low limit value IL irrespective of the acquired value of the rail pressure Pc. With a determination that the engine rotation speed is not in the high speed rotation state, the hold value Ih is set based on the acquired value of the rail pressure Pc, that is, value of the pre-opening rail pressure Pdrv. In summary, in the high rotation state, the hold value Ih is fixed to the low limit value IL by prohibiting the hold value Ih from being set to a value, which is lower than the low limit value IL.

Figure 13:
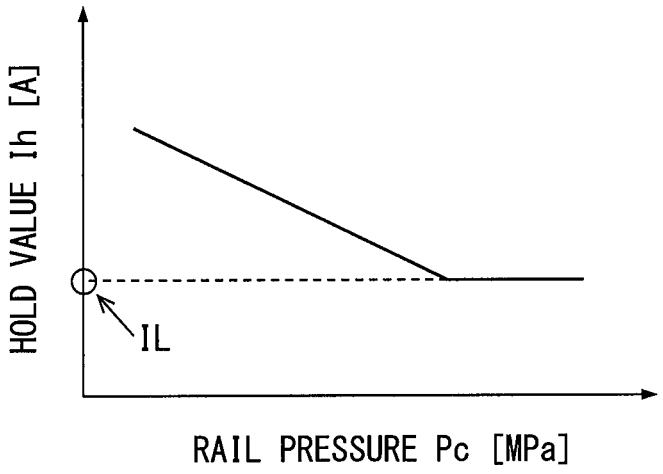
FIG. 13 is a data map showing a relation between a hold value and rail pressure.

Since the target rail pressure is set to increase as the engine rotation speed NE increases in the fourth embodiment, the hold value Ih is eventually set to the low limit value IL in the high rotation state, that is, the rail pressure Pc is high. For this reason, in place of the processing of steps S22 and S23, the hold value Ih may be set at step S30A based on a data map shown in FIG. 13. As shown in the data map of FIG. 13, the hold value Ih is set to decrease as the rail pressure Pc increases in a range that the rail pressure Pc is lower than the predetermined value and fixed to the low limit value IL in a range that the rail pressure Pc is higher than the predetermined pressure value.

The processing of acquiring the rail pressure Pc at step S50 of FIG. 12 is executed in synchronized relation with the crank angle at every predetermined interval of angular rotation of the crankshaft of the engine 10. That is, the processing of the decrease amount acquisition part (step S51) and the current re-supply part (step S52) is executed at every predetermined angular interval of the crankshaft rotation.

In the high rotation state described above, the interval of execution of steps S51 and S52 occasionally becomes shorter exceeding processing ability of the microcomputer 33 and the microcomputer 33 becomes disabled to normally execute the processing of steps S51 and S52. It thus becomes impossible to check at step S51 whether the pressure reduction is attained as a result of driving the pressure reducing valve 20. Hence it becomes impossible to increase the hold value at step S52 even in case that the valve-opening is disabled.

In the fourth embodiment, to counter this problem, the decrease amount of the rail pressure Pc is acquired each time the output shaft of the engine 10 rotates the predetermined angular interval. Further, the hold value setting part prohibits setting of the hold value Ih to the small value, which is smaller than the predetermined low limit value in case of the high rotation state, that is, when the rotation speed of the output shaft is equal to or higher than the predetermined rotation speed.

Thus, in case that the processing of steps S51 and S52 will possibly not be normally executed because of the high rotation state, the hold value Ih is set to be equal to or larger than the low limit value IL. It is therefore possible to avoid that, even in the high rotation state, the hold value is set to a small value because of the high rail pressure Pc and the valve opening is disabled.

Fifth Embodiment

Figure 14:
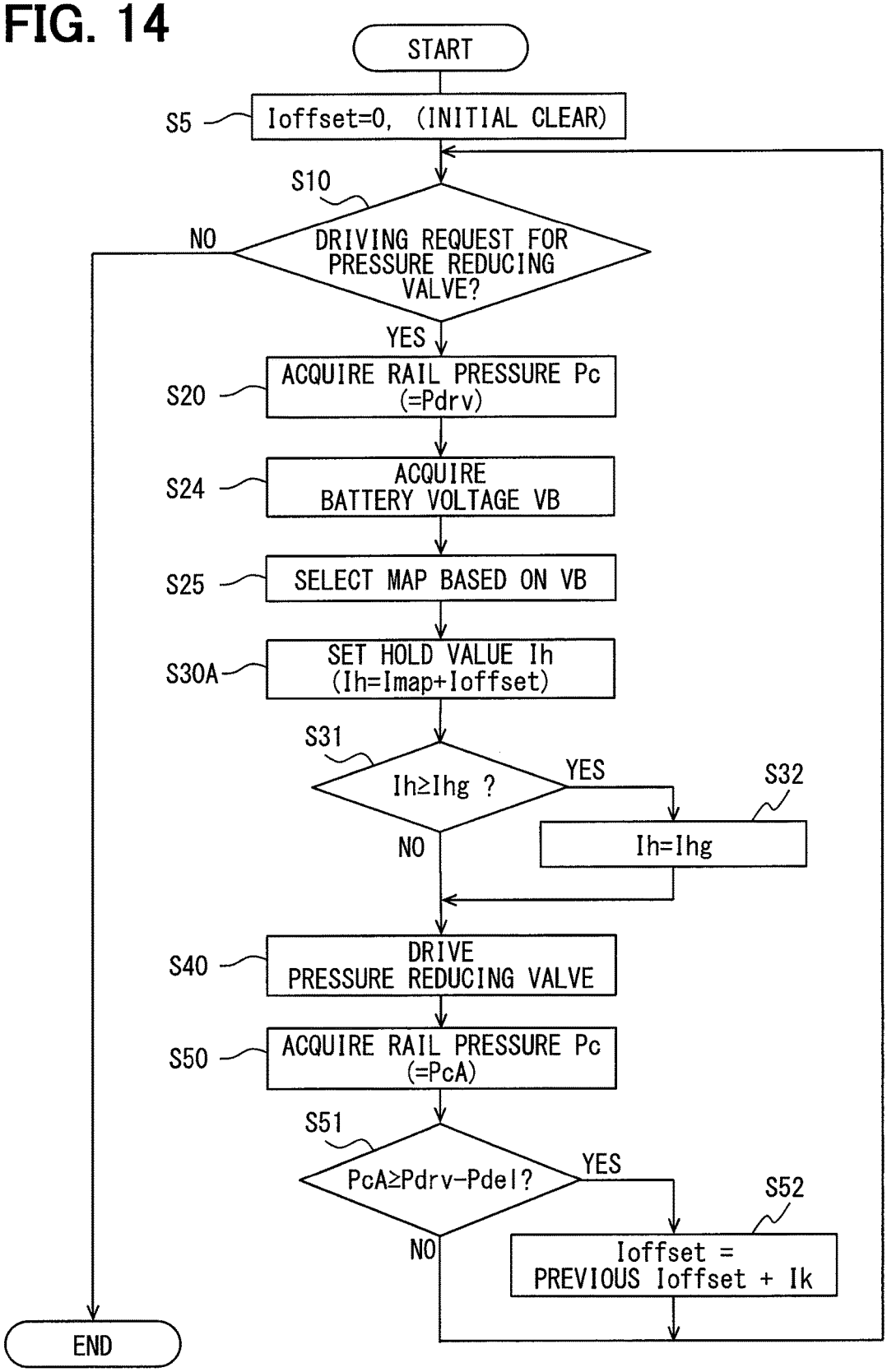
FIG. 14 is a flowchart showing control processing for driving a pressure reducing valve by setting a hold value in control executed by a pressure reducing valve control apparatus according to a fifth embodiment.

A fifth embodiment is similar to the second embodiment but different from the second embodiment in that the control contents shown in FIG. 8 are changed as shown in FIG. 14. The hardware configuration such as the pressure reducing valve 20 and the like, which are controlled by the ECU 30, is the same as the configuration shown in FIG. 1. Specifically, steps S24 and S25 are added in the control contents as shown in FIG. 12.

At processing of step S24, a terminal voltage of the battery 34, that is, a battery voltage VB is acquired. The microcomputer 33 operates as a voltage acquisition part, which acquires a voltage value applied to the electromagnetic coil 25, in executing the processing of step S24. The memory 32 stores a data map, which is used to set the hold value Ih based on the rail pressure Pc, for each battery voltage VB. Specifically, a value (map value Imap) corresponding to the rail pressure Pc is set to increase as the battery voltage decreases.

At next step S25, one of plural data maps stored in the memory 32 is selected based on the battery voltage VB acquired at step S24. For this reason, even in case that the values of the pre-opening rail pressure Pdry acquired at step S20 are the same, the map to be selected varies in dependence on the battery voltage VB acquired at step S24. The map value Imap to be used at step S30A (hold value setting part) thus varies and the hold value Ih correspondingly varies. Specifically, the hold value Ih is set to a larger value at step S30A as the value of the battery voltage VB is lower.

The fifth embodiment thus provides the following operation and advantage.

The ECU 30 according to the fifth embodiment has the voltage acquisition part (step S24), which acquires the battery voltage VB applied to the electromagnetic coil 25. The hold value setting part (step S30A) sets the hold value Ih to be higher as the voltage value acquired by the voltage acquisition part is lower. Since the hold value Ih is set to increase even in case that the battery voltage VB decreases because of an increase of electric loads other than the electromagnetic coil 25 and deterioration of the battery 34. With the increased hold value Ih, a decrease in the quantity of electric power supply to the coil is suppressed. Since the electromagnetic force Fc is thus restricted from decreasing because of the decrease of the battery voltage VB, it is possible to prevent the pressure reducing valve 20 from being disabled to open because of the low battery voltage VB and prevent the rail pressure Pc from not decreasing.

Other Embodiment

The present invention described above is not limited to the exemplified embodiments but may be modified in many other ways as exemplified below.

In the hardware configuration shown in FIG. 1, the common rail 12 is used as the accumulator device for accumulating and holding fuel and the ECU 30 is applied as the pressure reducing valve control apparatus to control the pressure reducing valve 20 attached to the common rail 12. The pressure reducing valve control apparatus may be applied to control a pressure reducing valve attached to an accumulator device other than the common rail 12. For example, the pressure reducing valve control apparatus may be applied to a fuel injection valve for injecting fuel and a fuel pump for pressurizing and feeding fuel.

The fuel injection valve includes a body, which is formed of a high-pressure fuel passage for flowing high-pressure fuel and an injection hole for injecting the high-pressure fuel, a needle-shaped valve body for opening and closing the high-pressure passage, a spring member for applying a spring force to the valve body in a valve-closing direction and an electromagnetic coil for applying electromagnetic force to the valve body in a valve-opening direction. The pressure reducing valve control apparatus supplies a current to the electromagnetic coil to drive the valve body to open in response to a fuel injection request. The pressure reducing valve control apparatus supplies no current to the electromagnetic coil to close the valve by the spring force. In case of current supply to the electromagnetic coil by the pressure reducing valve control apparatus, a driving voltage is applied to the electromagnetic coil in the similar way as in FIG. 3. That is, a boosted voltage is applied in an initial period T2 and a battery voltage is applied in a hold period T3. A hold value Ih in a hold period T3 is set to increase as pressure of fuel supplied to the high-pressure passage decreases.

In the second embodiment shown in FIG. 8, the offset value Ioffset is increased at step S52 in case that the decrease amount of the rail pressure Pc is smaller than the predetermined value PdeI. In this case, the offset value Ioffset is increased at step S52 as far as the decrease amount does not exceed the predetermined value PdeI, even when the rail pressure Pc has been decreased to be lower than the previous value. Differently from the second embodiment, the predetermined value PdeI may be set to zero.

The control executed in the fifth embodiment and shown in FIG. 14, that is, switchover of the data maps in correspondence to the battery voltage VB, may be used in the control shown in FIG. 6. That is, in setting the hold value Ih based on the data map at step S30 shown in FIG. 6, the map may be switched over depending on the battery voltage VB.

The control operations and functions executed by software processing of the microcomputer 33 in the ECU 30 may be attained by hardware circuits.

The invention claimed is:

1. A pressure reducing valve control apparatus for a pressure reducing valve attached to an accumulator for accumulating pressurized fuel in an accumulation chamber, the pressure reducing valve having an attachment part formed with a discharge passage for discharging the fuel from the accumulation chamber, a valve body arranged to receive fuel pressure in the accumulation chamber in a valve-opening direction and opening and closing the discharge passage, a spring member for applying spring force to the valve body in a valve-closing direction, an electromagnetic coil for applying electromagnetic force to the valve body in the valve-opening direction, the pressure reducing valve control apparatus characterized by comprising:

a hold control part for holding current supplied to the electromagnetic coil at a predetermined hold value after starting current supply to the electromagnetic coil and causing the valve body to start opening within a hold period of the hold value; and a hold value setting part for setting the hold value to increase as the fuel pressure in the accumulation chamber decreases.

2. The pressure reducing valve control apparatus according to claim 1, further comprising:

a decrease amount acquisition part for acquiring a decrease amount of the fuel pressure in the accumulation chamber caused by current supply to the electromagnetic coil; and a current re-supply part for setting again the hold value to a larger value, which is larger than the hold value used at present time, and supplying again the current to the electromagnetic coil by using the larger value, in case that the decrease amount acquired by the decrease amount acquisition part is smaller than a predetermined pressure value.

3. The pressure reducing valve control apparatus according to claim 2, further comprising:

a guard control part for limiting the hold value from being set to be larger than a predetermined guard value in setting the hold value again by the current re-supply part.

4. The pressure reducing valve control apparatus according to claim 2, further comprising:

a memory part for storing, as learning information, a relation between the fuel pressure in the accumulation chamber and the hold value used in the hold value setting part; and a learning part for updating, as the learning information, the relation between a pre-opening fuel pressure of the fuel in the accumulation chamber present before starting the current supply to the electromagnetic coil and the hold value used in the current supply at present time, wherein the hold value setting part sets the hold value based on the learning information stored in the memory part.

5. The pressure reducing valve control apparatus according to claim 2, wherein:

the decrease amount acquisition part acquires the decrease amount at every angular rotation of an output shaft of an internal combustion engine; and the hold value setting part prohibits the hold value from being set to a value smaller than a predetermined low limit value in case that a rotation speed of the output shaft is higher than a predetermined speed.

6. The pressure reducing valve control apparatus according to claim 1, further comprising:

a voltage acquisition part for acquiring a value of the voltage applied to the electromagnetic coil, wherein the hold value setting part sets the hold value to increase as a voltage value acquired by the voltage acquisition part decreases.

7. The pressure reducing valve control apparatus according to claim 1, further comprising:

a pressure reduction control part for decreasing the fuel pressure by driving the pressure reducing valve to open, the pressure reducing valve being attached to the accumulator formed as a common rail, which distributes fuel to multiple fuel injection valves for injecting fuel into combustion chambers of an internal combustion engine.

* * * * *